US010460709B2

(12) United States Patent
Bradley et al.

(10) Patent No.: US 10,460,709 B2
(45) Date of Patent: Oct. 29, 2019

(54) ENHANCED SYSTEM, METHOD, AND DEVICES FOR UTILIZING INAUDIBLE TONES WITH MUSIC

(71) Applicant: The Intellectual Property Network, Inc., Tucson, AZ (US)

(72) Inventors: Nathaniel T. Bradley, Tucson, AZ (US); Joshua S. Paugh, Tucson, AZ (US); Enrique C. Feldman, Tucson, AZ (US)

(73) Assignee: THE INTELLECTUAL PROPERTY NETWORK, INC., Tucson, AZ (US)

( * ) Notice: Subject to any disclaimer, the term of this patent is extended or adjusted under 35 U.S.C. 154(b) by 0 days.

(21) Appl. No.: 16/019,257

(22) Filed: Jun. 26, 2018

(65) Prior Publication Data

US 2018/0374460 A1 Dec. 27, 2018

Related U.S. Application Data

(60) Provisional application No. 62/524,835, filed on Jun. 26, 2017.

(51) Int. Cl.
*G10H 1/00* (2006.01)

(52) U.S. Cl.
CPC ..... *G10H 1/0008* (2013.01); *G10H 2210/066* (2013.01); *G10H 2220/121* (2013.01)

(58) Field of Classification Search
CPC ..... G06F 16/683; G06F 3/167; G10K 15/04; G06N 3/08; G10H 1/0008; G10H 1/0066; G10H 2240/171; G10H 3/125; G10H 2210/031; G10H 2220/011; G10H 2240/115; G06T 2201/0052
See application file for complete search history.

(56) References Cited

U.S. PATENT DOCUMENTS

| | | | |
|---|---|---|---|
| 4,399,731 | A | 8/1983 | Aoki |
| 4,479,416 | A | 10/1984 | Clague |
| 4,694,723 | A | 9/1987 | Shinohara et al. |
| 4,976,182 | A | 12/1990 | Obuchi et al. |
| 5,275,082 | A | 1/1994 | Kestner-Clifton et al. |
| 5,315,911 | A | 5/1994 | Ochi |
| 5,413,486 | A | 5/1995 | Burrows et al. |
| 5,533,903 | A | 7/1996 | Kennedy |
| 5,621,538 | A | 4/1997 | Gnant et al. |
| 5,690,496 | A | 11/1997 | Kennedy |
| 5,728,960 | A | 3/1998 | Sitrick |
| 5,746,605 | A | 5/1998 | Kennedy |
| 5,760,323 | A | 6/1998 | Romero et al. |
| 5,768,127 | A | 6/1998 | Murata |
| 5,773,741 | A | 6/1998 | Eller et al. |
| 5,931,680 | A | 8/1999 | Semba |
| 6,072,113 | A | 6/2000 | Tohgi et al. |
| 6,084,168 | A | 7/2000 | Sitrick |
| 6,096,962 | A | 8/2000 | Crowley |
| 6,156,964 | A | 12/2000 | Sahai et al. |

(Continued)

*Primary Examiner* — Marlon T Fletcher
(74) *Attorney, Agent, or Firm* — Goodhue, Coleman & Owens, P.C.

(57) ABSTRACT

One embodiment provides a system, method, and device for utilizing inaudible tones for music. A song is initiated with enhanced features. A determination is made whether inaudible tones including information or data are associated with a portion of the song. The associated inaudible tone is played. Playback of the song is continued.

20 Claims, 7 Drawing Sheets

(56) References Cited

U.S. PATENT DOCUMENTS 6,211,451 B1 4/2001 Tohgi et al.
6,235,979 B1 5/2001 Yanase
6,275,222 B1 8/2001 Desain
6,348,648 B1 2/2002 Connick
6,380,471 B2 4/2002 Matsumoto
6,380,474 B2 4/2002 Taruguchi et al.
6,392,132 B2 5/2002 Uehara
6,483,019 B1 11/2002 Hamilton
6,486,388 B2 11/2002 Akahori
6,504,089 B1 1/2003 Negishi et al.
6,515,210 B2 2/2003 Shibukawa
6,545,208 B2 4/2003 Hiratsuka
6,555,737 B2 4/2003 Miyaki et al.
6,664,458 B2 12/2003 Hiratsuka et al.
6,685,480 B2 2/2004 Nishimoto et al.
6,686,531 B1 2/2004 Pennock et al.
6,727,418 B2 4/2004 Matsumoto
6,777,607 B2 8/2004 Smith
6,798,427 B1 9/2004 Suzuki et al.
6,809,246 B2 10/2004 Errico
6,831,220 B2 12/2004 Varme
7,019,204 B2 3/2006 Terada
7,030,307 B2 4/2006 Wedel
7,041,888 B2 5/2006 Masuda
7,041,890 B1 5/2006 Sutton
7,045,698 B2 5/2006 Miyamoto
7,064,261 B2 6/2006 Shao
7,078,609 B2 7/2006 Georges
7,094,960 B2 8/2006 Ikeya et al.
7,094,962 B2 8/2006 Kayama
7,105,733 B2 9/2006 Jarrett et al.
7,119,266 B1 10/2006 Bittner et al.
7,129,407 B2 10/2006 Hiratsuka et al.
7,183,476 B2 2/2007 Swingle et al.
7,199,298 B2 4/2007 Funaki
7,199,299 B2 4/2007 Asakura
7,223,912 B2 5/2007 Nishimoto et al.
7,297,856 B2 11/2007 Sitrick
7,314,992 B2 1/2008 Funaki et al.
7,314,994 B2 1/2008 Hull et al.
7,335,833 B2 2/2008 Smith et al.
7,342,165 B2 3/2008 Gotfried
7,371,954 B2 5/2008 Masuda et al.
7,428,534 B2 9/2008 Ito et al.
7,439,441 B2 10/2008 Jarrett et al.
7,482,529 B1 1/2009 Flamini et al.
7,485,794 B2 2/2009 Koizumi
7,507,893 B2 3/2009 Knudsen
7,560,635 B2 7/2009 Funaki
7,589,271 B2 9/2009 Jarrett et al.
7,589,727 B2 9/2009 Haeker
7,601,905 B2 10/2009 Yanase et al.
7,605,322 B2 10/2009 Nakamura
7,640,501 B2 12/2009 Suzuki et al.
7,642,447 B2 1/2010 Kojima
7,683,250 B2 3/2010 Ikeya et al.
7,703,014 B2 4/2010 Funaki
7,765,314 B2 7/2010 Okamoto
7,767,898 B2 8/2010 Nakayama et al.
7,829,777 B2 11/2010 Kyuma et al.
8,106,282 B2 1/2012 Lee
8,138,409 B2 3/2012 Brennan
8,158,874 B1 4/2012 Kenney
8,319,083 B2 11/2012 Adams
8,367,921 B2 2/2013 Evans et al.
8,497,416 B2 7/2013 Gregson
8,513,511 B2 8/2013 Ikeya et al.
8,629,342 B2 1/2014 Lee et al.
8,642,871 B2 2/2014 Feidner
8,660,678 B1 2/2014 Lavi et al.
8,680,388 B2 3/2014 Becker et al.
8,688,250 B2 * 4/2014 Iwase ..... G10H 1/0066 700/94
8,785,757 B2 7/2014 Pillhofer et al.
8,878,040 B2 11/2014 Araki et al.
9,006,551 B2 * 4/2015 Iwase ..... G10H 1/0066 84/612
9,029,676 B2 5/2015 Iwase et al.
9,035,162 B2 5/2015 Hamilton et al.
9,082,380 B1 7/2015 Hamilton et al.
9,092,992 B2 7/2015 Yung
9,093,055 B2 7/2015 Daisy-Cavaleri
9,105,259 B2 8/2015 Akazawa et al.
9,116,509 B2 8/2015 Takahashi et al.
9,120,016 B2 9/2015 Epstein
9,183,754 B2 11/2015 Tanaka
9,275,616 B2 3/2016 Uemura et al.
9,333,418 B2 5/2016 Lee et al.
9,412,352 B2 8/2016 Uemura
9,418,638 B2 8/2016 Soejima
9,424,822 B2 8/2016 Bisnauth
9,472,178 B2 10/2016 Kruge
9,545,578 B2 1/2017 Nathan et al.
9,576,564 B2 2/2017 Yamauchi et al.
9,601,029 B2 3/2017 Gebauer
9,601,127 B2 3/2017 Yang et al.
9,620,095 B1 4/2017 Hamilton et al.
9,640,160 B2 5/2017 Wang et al.
2004/0003707 A1 * 1/2004 Mazzoni ..... G10H 1/0025 84/613
2005/0257666 A1 * 11/2005 Sakurada ..... G10H 1/0066 84/609
2018/0374460 A1 * 12/2018 Bradley ..... G10H 1/0008
2019/0082224 A1 * 3/2019 Bradley ..... H04N 21/4756
2019/0122691 A1 * 4/2019 Roy ..... G10L 21/06

* cited by examiner

ENHANCED SYSTEM, METHOD, AND DEVICES FOR UTILIZING INAUDIBLE TONES WITH MUSIC

PRIORITY

This application claims priority to U.S. Provisional Patent Application Ser. No. 62/524,835 entitled ENHANCED SYSTEM, METHOD, AND DEVICES FOR UTILIZING INAUDIBLE TONES WITH MUSIC filed on Jun. 26, 2017, the entirety of which is incorporated by reference herein.

BACKGROUND

I. Field of the Disclosure

The illustrative embodiments relate to music. More specifically, but not exclusively, the illustrative embodiments relate to enhancing music through associating available information.

II. Description of the Art

Teaching, learning, and playing music may be very challenging for individuals. It may be even more difficult for students and others with limited exposure to music notes, theory, or instruments. Unfortunately, music advancement has not kept pace with advancements in technology and resources to create, teach, learn, and play music more easily and increase accessibility for individuals of all skill levels, cognition, and abilities.

SUMMARY OF THE DISCLOSURE

The illustrative embodiments provide a system, method, and device for utilizing inaudible tones for music. A song is initiated with enhanced features. A determination is made whether inaudible tones including information or data are associated with a portion of the song. The associated inaudible tone is played. Playback of the song is continued. Another embodiments provides a device including a processor for executing a set of instructions and a memory for storing the set of instructions. The instructions are executed to perform the method described above.

Another embodiment provides a method for utilizing inaudible tones for music. Music and inaudible tones associated with the music are receiving utilizing an electronic device including at least a display. Information associated with the inaudible tones is extracted. The information associated with the inaudible tones is communicated. Another embodiments provides a receiving device including a processor for executing a set of instructions and a memory for storing the set of instructions. The instructions are executed to perform the method described above.

Yet another embodiment provides a system for utilizing inaudible tones in music. The system includes a transmitting device that broadcasts music synchronized with one or more inaudible tones. The system includes a receiving device that receives the inaudible tones, extracts information associated with the inaudible tones, and communicates the information associated with the inaudible tones.

BRIEF DESCRIPTION OF THE DRAWINGS

Illustrated embodiments are described in detail below with reference to the attached drawing figures, which are incorporated by reference herein, and where.

DETAILED DESCRIPTION OF THE DISCLOSURE

The illustrative embodiments provide a system and method for utilizing inaudible tones integration with visual sheet music, inaudible time codes, musical piece displays, live music capture, execution, and marking, and musical accompaniment suggestions. The illustrative embodiments may be implemented utilizing any number of musical instruments, wireless devices, computing devices, or so forth. For example, an electronic piano may communicate with a smart phone to perform the processes and embodiments herein described. The illustrative embodiments may be utilized to create, learn, play, observe, or teach music.

The illustrative embodiments may utilize inaudible tones to communicate music information, such as notes being played. A visual and text representation of the note, notes, or chords may be communicated. The illustrative embodiments may be utilized for recorded or live music or any combination thereof. The inaudible tones may be received and processed by any number of devices to display or communicate applicable information.

Figure 1:
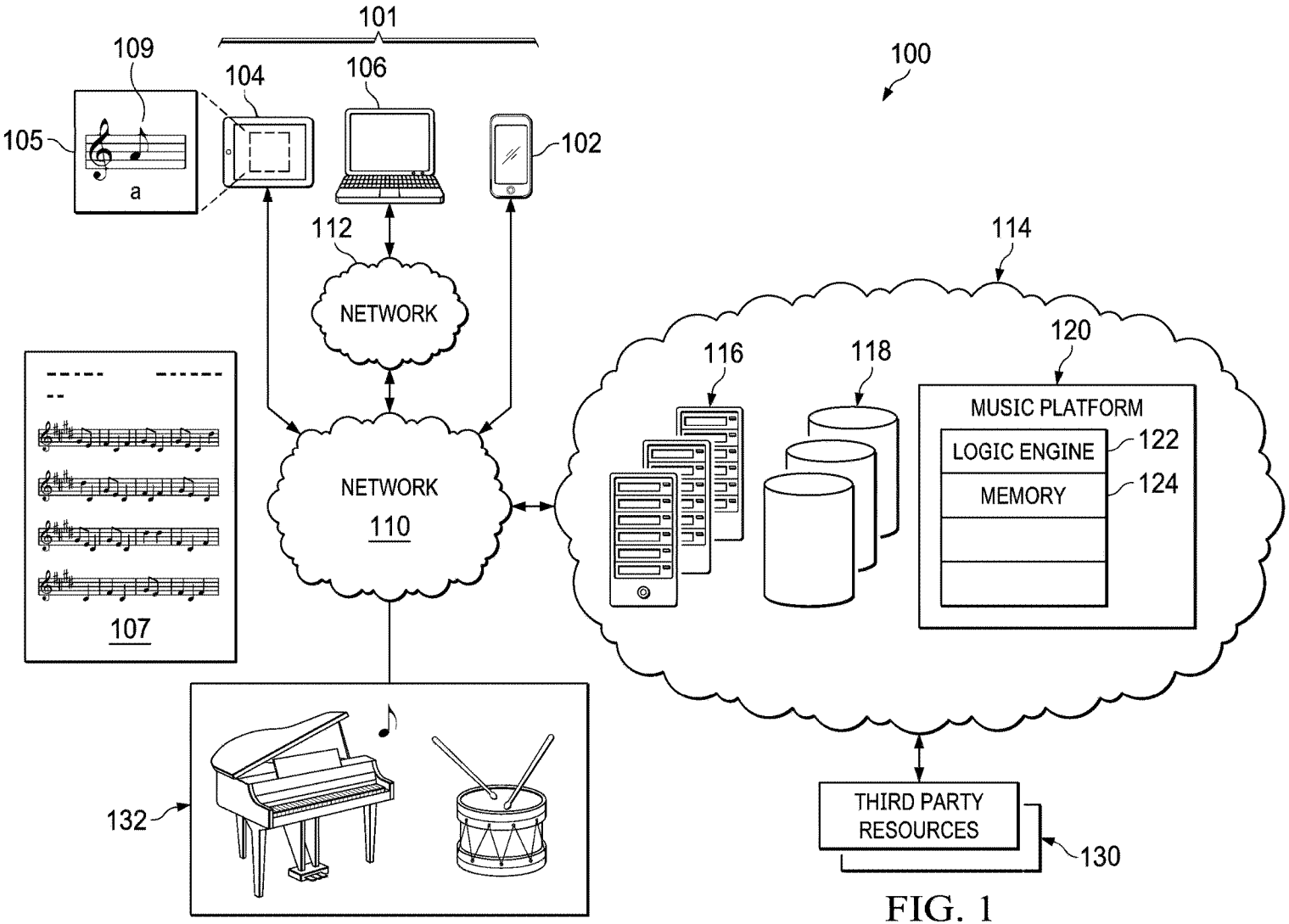
FIG. 1 is a pictorial representation of a system for utilizing inaudible tones in accordance with an illustrative embodiment.

FIG. 1 is a pictorial representation of a system 100 for utilizing inaudible tones in accordance with an illustrative embodiment. In one embodiment, the system 100 of FIG. 1 may include any number of devices 101, networks, components, software, hardware, and so forth. In one example, the system 100 may include a wireless device 102, a tablet 104 utilizing a graphical user interface 105, a laptop 106 (altogether devices 101), a network 110, a network 112, a cloud network 114, servers 116, databases 118, and a music platform 120 including at least a logic engine 122, and memory 224. The cloud network 114 may further communicate with third-party resources 130.

In one embodiment, the system 100 may be utilized by any number of users to learn, play, teach, observe, or review music. For example, the system 100 may be utilized with musical instruments 132. The musical instruments 132 may represent any number of acoustic, electronic, networked, percussion, wind, string, or other instruments of any type. In one embodiment, the wireless device 12, tablet 104, or laptop 106 may be utilized to display information to a user, receiver user input, feedback, commands, and/or instructions, record music, store data and information, play inaudible tones associated with music, and so forth.

The system 100 may be utilized by one or more users at a time. In on embodiment, an entire band, class, orchestra, or so forth may utilize the system 100 at one time utilizing their own electronic devices or assigned or otherwise provided devices. The devices 101 may communicate utilizing one or more of the networks 110, 112 and the cloud network 114 to synchronize playback, inaudible tones, and the playback process. In one embodiment, software operated by the devices of the system 100 may synchronize the playback and learning process. For example, mobile applications executed by the devices 101 may perform synchronization, communications, displays, and the processes herein described. The devices 101 may play inaudible tones as well as detect music, tones, inaudible tones, and input received from the instruments 132.

The inaudible tones discussed in the illustrative embodiments may be produced from the known tone spectrum in an audio range that is undetectable to human ears. The inaudible tone range is used to carry data transmissions to implement processes, perform synchronization, communicate/display information, and so forth. Any number of standard or specialized devices may perform data recognition, decoding, encoding, transmission, and differentiation via the inaudible tone data embedded in the inaudible tones.

The inaudible tones may be combined in various inaudible tone ranges that are undetectable to human ears. The known human tone range of detection can vary from 20 Hz to 20,000 Hz. The illustrative embodiments utilize the inaudible tone spectrum in the ranges of 18 Hz to 20 Hz and 8 KHz to 22 KHz, which both fall under the category of inaudible frequencies. The inaudible tones at 8 kHz, 10 kHz, 12 kHz, 14 kHz, 15 kHz, 16 kHz, 17 kHz, 17.4 kHz, 18 kHz, 19 kHz, 20 kHz, 21 kHz, and 22 kHz may be particularly useful. The illustrative embodiments may also utilize Alpha and Beta tones which use varied rates of inaudible tone frequency modulation and sequencing to ensure a broader range of the inaudible tone frequency spectrum is available from each singular inaudible tone range. The illustrative embodiments may also utilize audible tones to perform the processes, steps, and methods herein described.

The inaudible tones carry data that is processed and decoded via microphones, receivers, sensors, or tone processors. The microphones and logic that perform inaudible tone processing be pre-installed on a single purpose listening device or installed in application format on any standard fixed or mobile device with a built-in microphone and processor. The inaudible tones include broadcast data from various chips or tone transmission beacons, which are recognized and decoded at the microphone and logic.

The devices 101 are equipped to detect and decode data contained in the inaudible signals sent from any number of other sources. The devices 101 as well as the associated inaudible tone applications or features be programmed in an always on, passive listening, scheduled listening mode or based on environmental conditions, location (e.g., school, classroom, field, venue, etc.), or other conditions, settings, and/or parameters. In one embodiment, the music-based data and information may also be associated with the inaudible tones so that it does not have to be encoded or decoded.

The devices 101 may be portable or fixed to a location (e.g., teaching equipment for a classroom). In one embodiment, the devices 101 may be programmed to only decode tones and data specific to each system utilization. The devices 101 may also be equipped to listen for the presence or absence of specific tones and recognize the presence of each specific tone throughout a location or environment. The devices 101 may also be utilized to grant, limit or deny access to the system or system data based on the specific tone.

In one embodiment, the inaudible tones associated with a particular piece of music, data, or information may be stored in the memories of the devices 101 of the system 100, in the databases 118, or the memory 124 of the music platform 120 or in other memories, storage, hardware, or software. Similarly, the devices 101 of the system 100 may execute software that coordinates the processes of the system 100 as well as the playback of the inaudible tones.

In one embodiment, cloud network 114 or the music platform 120 may coordinate the methods and processes described herein as well as software synchronization, communication, and processes. The software may utilize any number of speakers, microphones, tactile components (e.g., vibration components, etc.) graphical user interfaces, such as the graphical user interface 105 to communicate and receive indicators, inaudible tones, and so forth.

The system 100 and devices may utilize speakers and microphones as inaudible tone generators and inaudible tone receivers to link music 107, such as sheet music notation or tablature-based notes to the tempo of a song creating a visual musical score. The process utilizes sound analysis tools on live and pre-produced musical pieces 107 or may be used with other tablature, standard sheet music, and sheet music creation tools (music 107).

The inaudible tone recognition tool ties sheet music 107 to the actual audio version of a song and in real-time to visually broadcasts each note 109 (notes, chord) that each instrument or voice produced during the progression of a song and visually displays the note in conjunction with the rhythm of the song through an inaudible tone. The note 109 may represent a single note, multiple notes, groups or sets of notes, or a chord. As shown, the note 109 may be displayed by the graphical user interface 105 by an application executed by the wireless device 104. The note 109 may be displayed graphically as a music node as well as the associated text or description, such as "a". The note 109 may also indicate other information, such as treble clef or bass clef.

In another embodiment, primary or key notes 109 of the music 107 may be displayed to the devices 101 based on information from the inaudible tones. Alternatively, a user (e.g., teacher, student, administrator, etc.) may select preselect or indicate in real-time the notes 109 from the music 107 to be displayed. The note 109 may be displayed individually or as part of the music 105. For example, the note 109 may light up, move, shake, or be otherwise be animated when played.

As noted, any number of devices 101 may be utilized to display the associated music 105, notes 109, and content. In addition, one of the devices 101 may coordinate the display and playback of information, such as a cell phone, table, server, personal computer, gaming device, or so forth.

Any number of flags, instructions, codes, inaudible tones, or other indicators may be associated with the notes 109, information, instructions, commands, or data associated with the music 107. As a result, the indicators may show the portion of the music being played. The indicators may also provide instructions or commands or be utilized to automatically implement an action, program, script, activity, prompt, display message, or so forth. The indicators may also include inaudible codes that may be embedded within music to perform any number of features or functions.

Inaudible time codes are placed within the piece of music 107 indicating the title and artist, the availability of related sheet music for the song, the start and finish of each measure, the vocal and instrumental notes or song tablature for each measure, and the timing and tempo fluctuations within a measure. The system 100 may also visually pre-indicate when a specific instrument or groups of instruments will enter in on the piece of music 107. Through the utilization of inaudible time codes embedded in the song and its measures the system can adjust the notes to the tempo and rhythm of music 107 that has numerous or varied tempo changes.

Multiple different inaudible tones may be associated with the different information outlined herein. The inaudible tones may facilitate teaching, learning, playing, or otherwise being involved with music playing, practice, or theory. For example, the inaudible tones may be embedded in the soundtrack of a broadcast. The inaudible tones may be delivered through any number of transmissions utilizing digital or analog communications standards, protocols, or signals. For example, the inaudible tones may represent markers resulting in the ability to play back and display sheet music notes 109 on time and synchronized with the music.

The music 107 or song data may include artist, title, song notes, tablature, and other information for a specific piece of music are transmitted from the song data contained in the inaudible tones via a network broadcast, wireless signal, satellite signal, terrestrial signal, direction connection, peer-to-peer connection, software based communication, via a music player, to a device, mobile device, wearable, e-display, electronic equalizer, holographic display, projected, or streamed to a digital sheet music stand or other implementation that visually displays the notes 109 and tempo that each specific instrument will play.

Through the user interface 106, a digital display, or visually projected musical representation each instrument and its associated notes 109 may be displayed in unison as the piece of music 107 plays. In one embodiment, each instrument in a musical piece 107 may be is assigned a color indicator or other visual representations. The display may also be selectively activated to highlight specific instrumental musical pieces. The instrument and representative color is visually displayed in a musical staff in standard musical notation format or in single or grouped notes 109 format that represent one or a chorded group of the 12 known musical notes A-G# or may be visually displayed as a standard tablature line that that displays the musical notes 109 in a number-based tablature format.

In one embodiment, one of the devices 101 may be a car radio. The car radio may display the notes 109 of the music 107. The system 100 may be effective in communicating the inaudible tones to any device within range to receive the inaudible tones. For example, the range of the inaudible tones may be only be limited by the acoustic and communications properties of the environment.

Live Music Capture, Execution, and Marking: In one embodiment, the system 100 utilizes a software-based sound capture process that is compatible with the devices 101 used to capture the inaudible tone song data. The devices 101 may capture the inaudible tone song data and in real-time capture, produce and analyze a real-time progression of the actual visual musical piece 107 in conjunction with the piece 107 being played by a live band, live orchestra, live ensemble performance, or other live music environment. The sound capture devices 101 that capture the inaudible song data may also capture each live instrumental note as it is played by a single instrument or group of performers' and is indicated with a visual representation that indicates a played note 105 is on time with the software based internal metronome marking the time in a musical piece 107.

The system 100 may indicate if each note 105 is played correctly which displays the note 105 in green as a correctly executed note, or if the note 105 is off beat or incorrect the note 109 displays red on the metronome tick as an incorrectly executed note, the metronome may also indicate if a specific instruments note was played too fast or too slow. The system 100 may also generate a report for each instrument and each instrumentalist's overall success rate for each note, timing, and other performance characteristics as played in a musical score. The report may be saved or distributed as needed or authorized.

Musical Accompaniment Suggestions: The system 100 may also make rhythmic or tempo based suggestions in addition to suggest new musical accompaniment that isn't included or heard in the original music piece 107. For example, the suggestions may be utilized to teach individuals how to perform improvisation and accompaniment. The system 100 may group specific instruments and may also indicate where other instruments may be added to fit into a piece of music 107. The system 100 may also make recommendations where new musical instrumental elements might fit into an existing piece of music 107. This also includes suggested instrumental or vocal elements, computer generated sounds, or other musical samples. The system 100 may indicate where groups of instruments share the same notes and rhythm pattern in the music 107. The system 100 may allow conductors or music composers to create and modify music 107 in real-time as it is being played or created.

Figure 2:
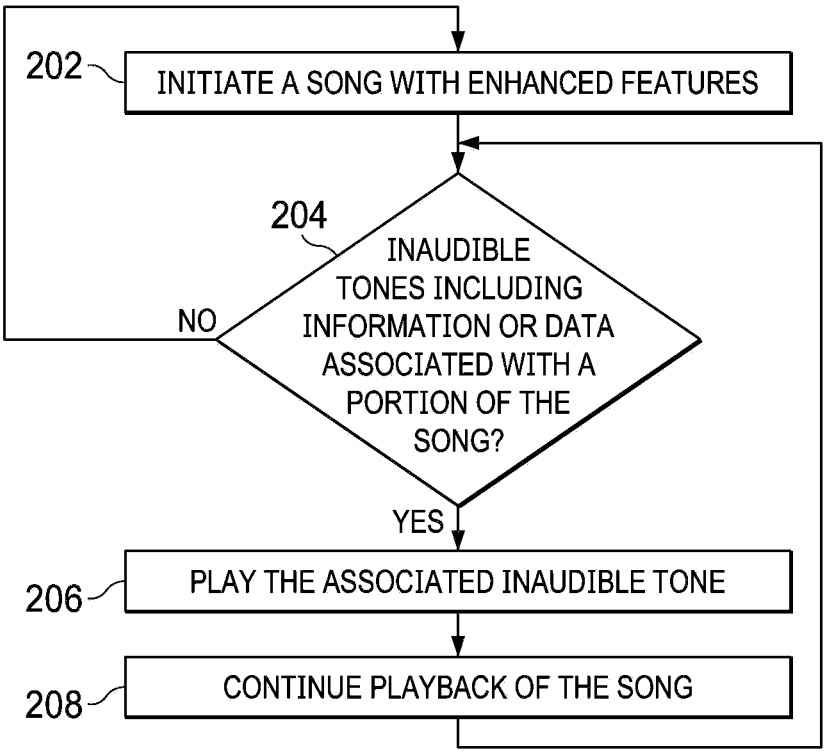
FIG. 2 is a flowchart of a process for utilizing inaudible tones in accordance with an illustrative embodiment.

FIG. 2 is a flowchart of a process for utilizing inaudible tones in accordance with an illustrative embodiment. In one embodiment, a song may represent electronic sheet music, songs, teaching aids, digital music content, or any type of musical content. The process of FIG. 2 may be performed by an electronic device, system, or component. For example, a personal computer (e.g., desktop, laptop, tablet, etc.), wireless device, DJ system, or other device may be utilized. The process of FIG. 2 may begin by initiating a song with enhanced features (202). The song may be initiated for audio or visual playback, display, communication, review, teaching, projection, or so forth. In one example, the song may be initiated to teach an orchestral group of a middle school the song. The song may include a number of parts, notes, and musical combinations for each of the different participants. The song may also represent a song played for recreation by a user travelling in a vehicle (e.g., car, train, plane, boat, etc.).

Next, the device determines whether there are inaudible tones including information or data associated with a portion of the song (step 204). Step 204 may be performed repeatedly for different portions or parts of the song corresponding to lines, measures, notes, flats, bars, transitions, verse, chorus, bridge, intro, scale, coda, notations, lyrics, melody, solo, and so forth. In one embodiment, each different portion of the song may be associated with inaudible information and data.

Next, the device plays the associated inaudible tone (step 206). The inaudible tone may be communicated through any number of speakers, transmitters, emitters, or other output devices of the device or in communication with the device. In one embodiment, the inaudible tone is simultaneously broadcast as part of the song. The inaudible tones represent a portion of the song that is unhearable by the listeners.

Next, the device continues playback of the song (step 208). Playback is continued until the song has been completed, the user selects to end the process, or so forth. In one embodiment, during step 208, the device may move from one portion of the song to the next portion of the song (e.g., moving from a first note to a second note). As noted, the playback may include real-time or recorded content. In one example, the content is a song played by a band at a concert. In another example, the content may represent a classical orchestral piece played from a digital file.

Next, the device returns again to determine whether there is inaudible information or data associated with a portion of the song (step 204). As noted, the process of FIG. 2 is performed repeatedly until the song is completed.

Figure 3:
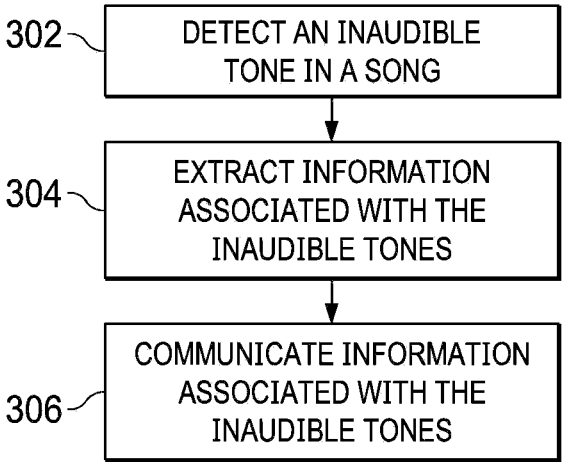
FIG. 3 is a flowchart of a process for processing inaudible tones in accordance with an illustrative embodiment.

FIG. 3 is a flowchart of a process for processing inaudible tones in accordance with an illustrative embodiment. The process of FIG. 3 may be performed by any number of receiving devices. In one embodiment, the process may begin by detecting an inaudible tone in a song (step 302). The number and types of devices that may detect the inaudible tones is broad and diverse. The devices may be utilized for learning, teaching, entertainment, collaboration, development, or so forth.

Next, the device extracts information associated with the inaudible tones (step 304). The data and information may be encoded in the inaudible tones in any number of analog or digital packets, protocols, formats, or signals (e.g., data encryption standard (DES), triple data encryption standard, Blowfish, RC4, RC2, RC6, advanced encryption standard). Any number of ultrasonic frequencies and modulation/demodulation may be utilized for data decoding, such as chirp technology. The device may utilize any number of decryption schemes, processes, or so forth. The information may be decoded as the song is played. As previously noted, the information may be synchronized with the playback of the song. In some embodiments, network, processing, and other delays may be factored in to retrieve the information in a timely manner for synchronization. For example, the inaudible tones may be sent slightly before a note is actually played so that step 306 is being performed as the associated note is played.

Next, the device communicates information associated with the inaudible tones (step 306). In one embodiment, the device may display each note/chord of the song as it is played. For example, a zoomed visual view of the note and the text description may be provided (e.g., see for example note 109 of FIG. 1). The information may also be displayed utilizing tactile input, graphics, or other content that facilitate learning, understanding, and visualization of the song. The communication of the information may help people learn and understand notes, tempo, and other information associated with the song. During step 306, the device may also perform any number of actions associated with the inaudible tones.

In one embodiment, the device may share the information with any number of other devices proximate the device. For example, the information may be shared through a direct connection, network, or so forth.

Figure 4:
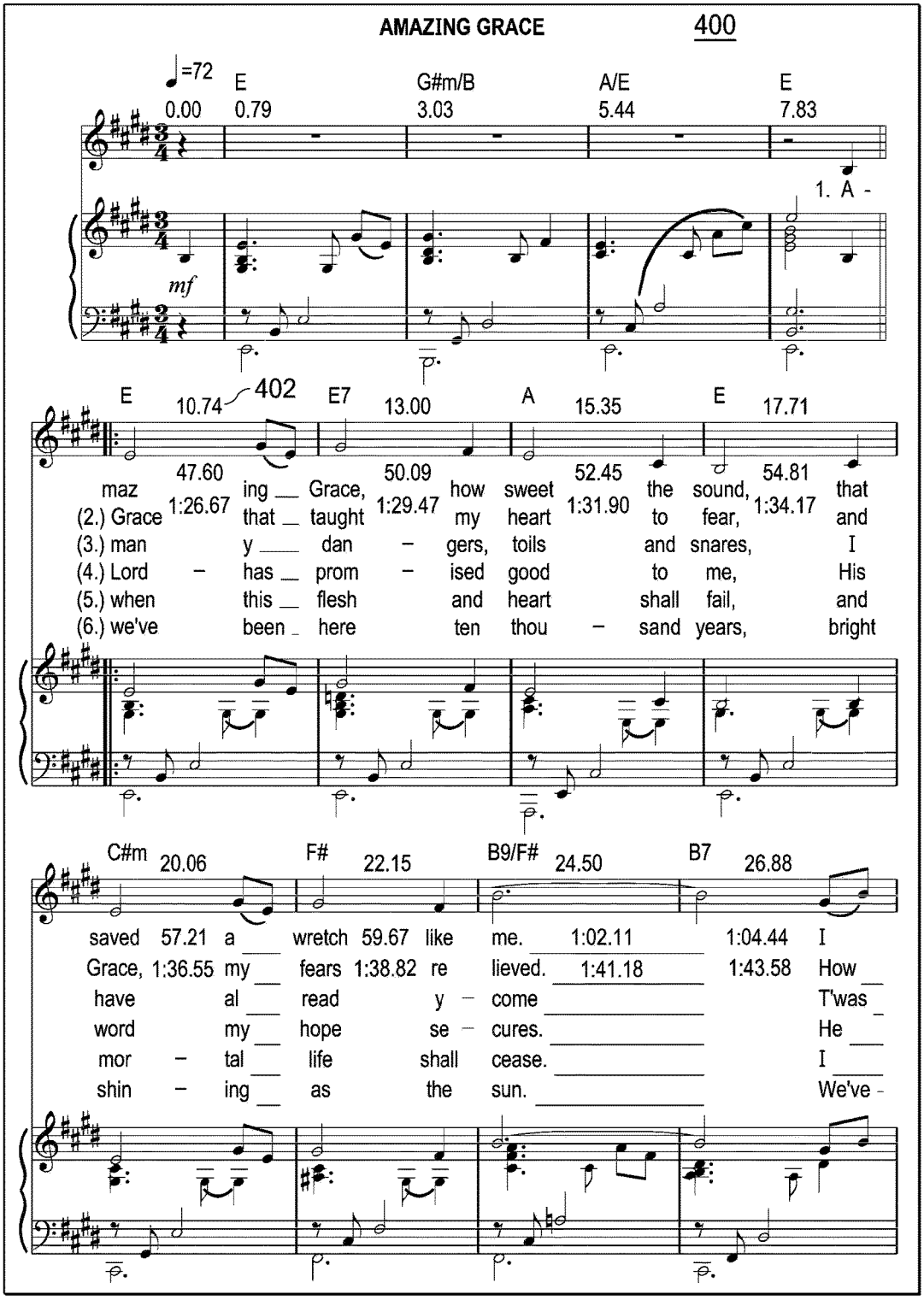
FIGS. 4 and 5 are a first embodiment of sheet music including notations for utilizing a system in accordance with illustrative embodiments.
Figure 5:
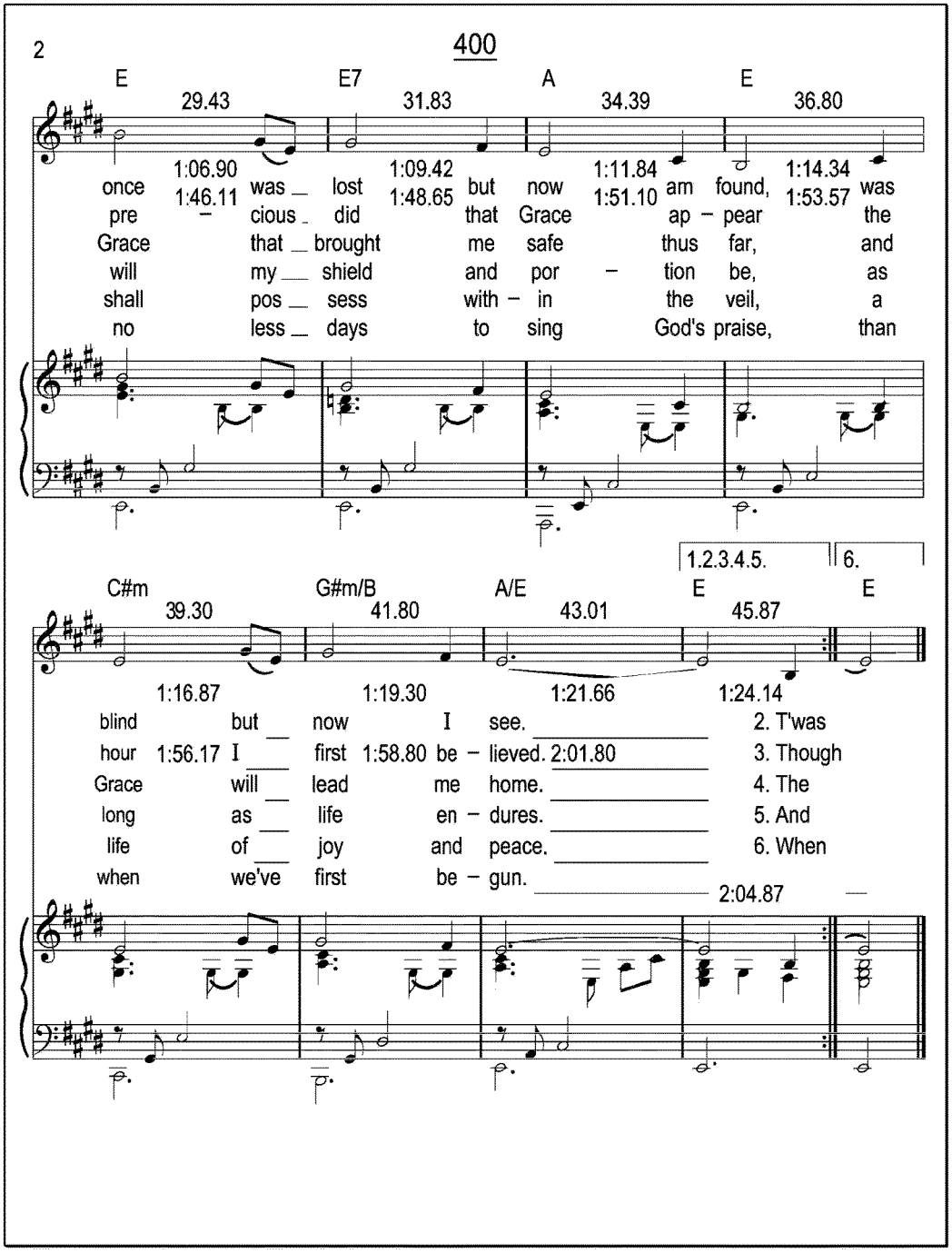
Figure 6:
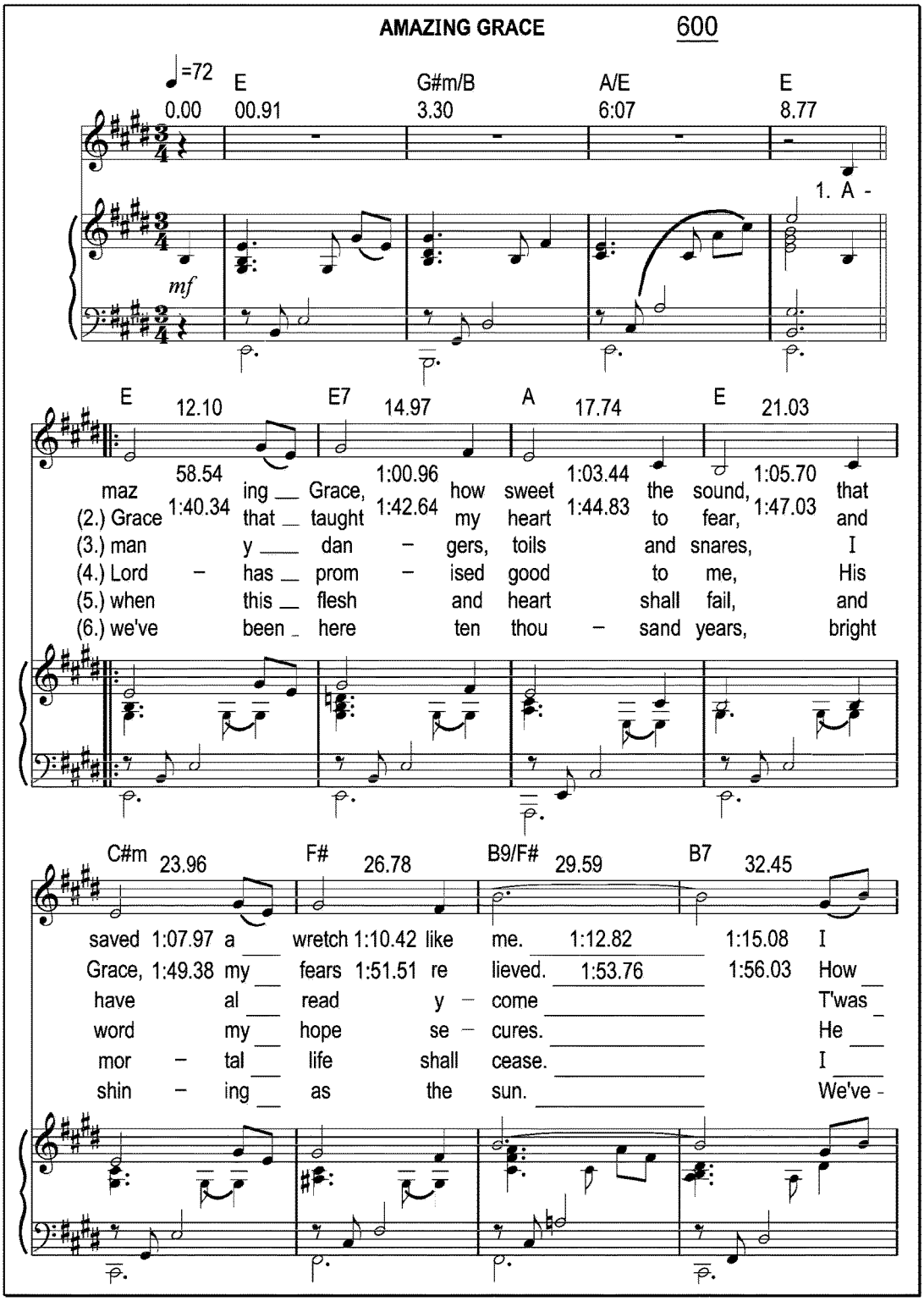
FIGS. 6 and 7 are a second embodiment of sheet music including notations for utilizing an inaudible system in accordance with illustrative embodiments.
Figure 7:
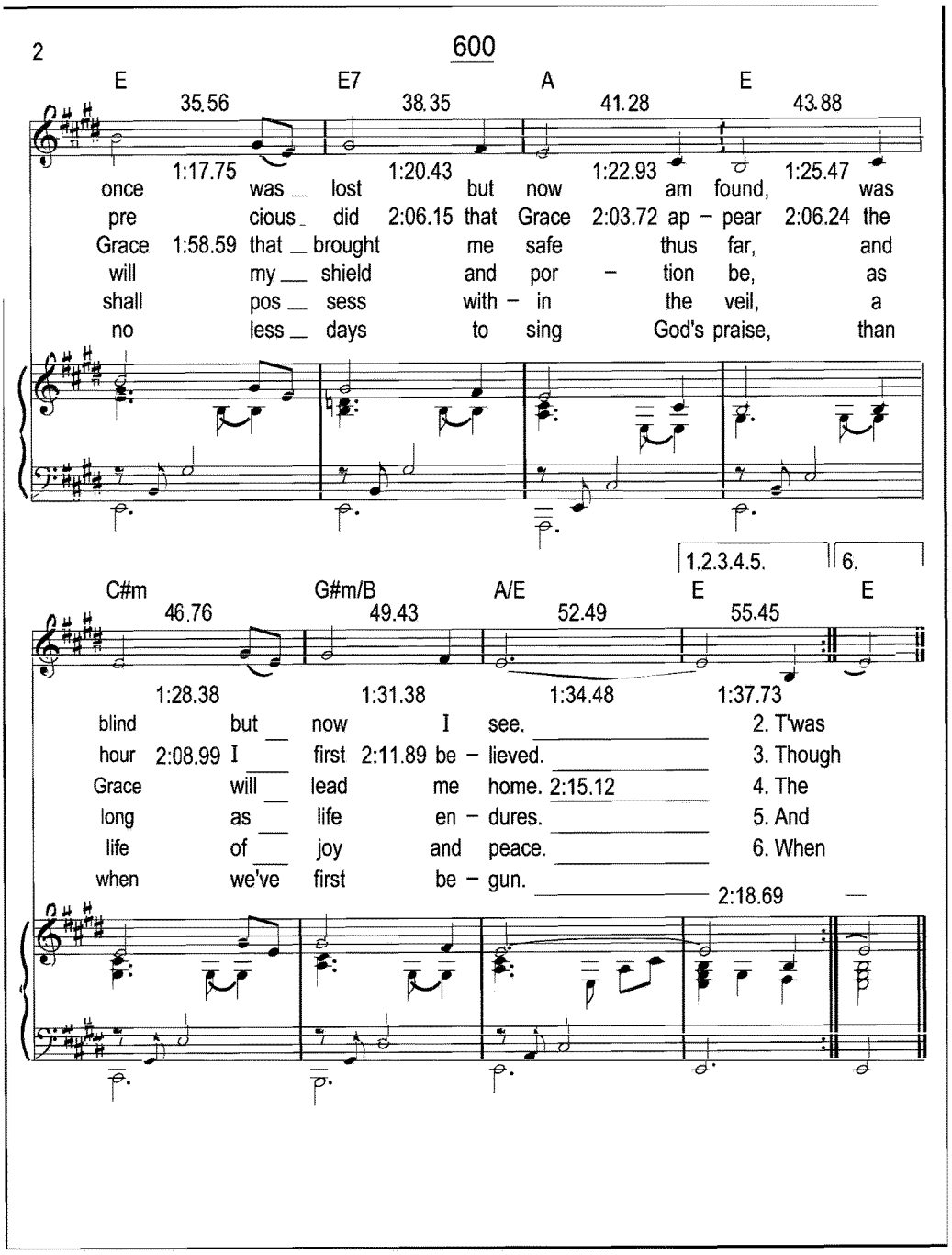

FIGS. 4 and 5 are a first embodiment of sheet music 400 including notations for utilizing a system in accordance with illustrative embodiments. FIGS. 6 and 7 are a second embodiment of sheet music 600 including notations for utilizing an inaudible system in accordance with illustrative embodiments. The embodiments shown in FIGS. 4-7 represent various versions of Amazing Grace. In one embodiment, time codes 402 of the measures (bars) and tempo show how the illustrative embodiments utilize indicators to display music. In one embodiment, the indicators may each be associated with inaudible tones. For example, at time code 10.74 the inaudible tone may communicate content to display the note "e" visually as well as textually. As shown by the time codes 402 any number of note/chord combinations may also be displayed. In addition, the time codes 402 may be applicable to different verses of the song.

The illustrative embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer usable program code embodied in the medium. The described embodiments may be provided as a computer program product, or software, that may include a machine-readable medium having stored thereon instructions, which may be used to program a computing system (or other electronic device(s)) to perform a process according to embodiments, whether presently described or not, since every conceivable variation is not enumerated herein. A machine-readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

Computer program code for carrying out operations of the embodiments may be written in any combination of one or more programming languages, including an object-oriented programming language such as Java, Smalltalk, C++ or the like and conventional procedural programming languages, such as the "C" programming language or similar programming languages. The program code may execute entirely on a user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN), a wireless personal area network (WPAN), or a wide area network (WAN), or the connection may be made to an external computer (e.g., through the Internet using an Internet Service Provider).

Figure 8:
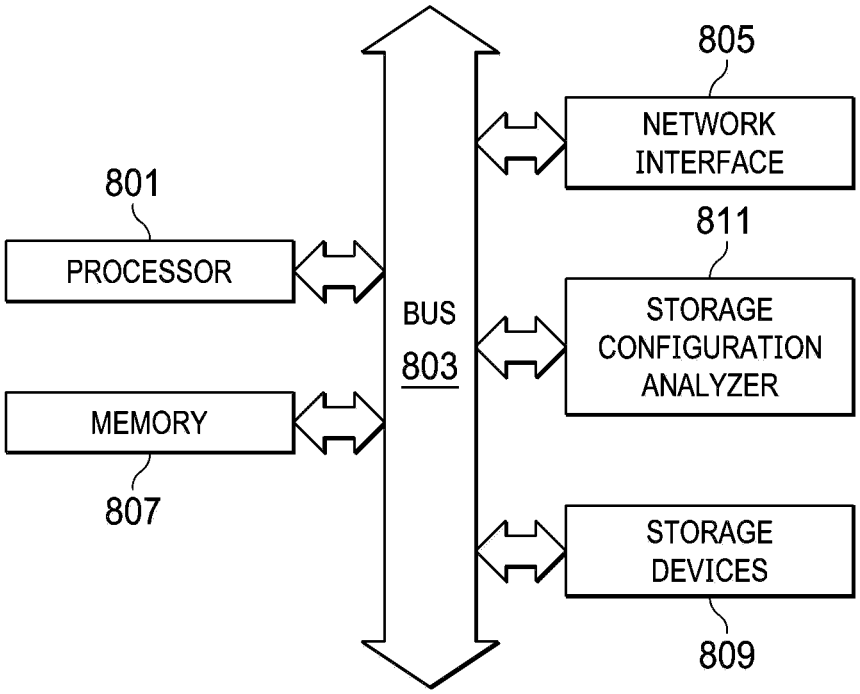
FIG. 8 depicts a computing system in accordance with an illustrative embodiment.

FIG. 8 depicts a computing system 800 in accordance with an illustrative embodiment. For example, the computing system 800 may represent a device, such as the wireless device 102 of FIG. 1. The computing system 800 includes a processor unit 801 (possibly including multiple processors, multiple cores, multiple nodes, and/or implementing multithreading, etc.). The computing system includes memory 807. The memory 807 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computing system also includes a bus 803 (e.g., PCI, ISA, PCI-Express, HyperTransport®, InfiniBand®, NuBus, etc.), a network interface 806 (e.g., an ATM interface, an Ethernet interface, a Frame Relay interface, SONET interface, wireless interface, etc.), and a storage device(s) 809 (e.g., optical storage, magnetic storage, etc.).

The system memory 807 embodies functionality to implement all or portions of the embodiments described above. The system memory 807 may include one or more applications or sets of instructions for implementing a communications engine to communicate with one or more electronic devices or networks. The communications engine may be stored in the system memory 807 and executed by the processor unit 802. As noted, the communications engine may be similar or distinct from a communications engine utilized by the electronic devices (e.g., a personal area communications application). Code may be implemented in any of the other devices of the computing system 800. Any one of these functionalities may be partially (or entirely) implemented in hardware and/or on the processing unit 801. For example, the functionality may be implemented with an application specific integrated circuit, in logic implemented in the processing unit 801, in a co-processor on a peripheral device or card, etc. Further, realizations may include fewer or additional components not illustrated in FIG. 8 (e.g., video cards, audio cards, additional network interfaces, peripheral devices, etc.). The processor unit 801, the storage device(s) 809, and the network interface 805 are coupled to the bus 803. Although illustrated as being coupled to the bus 803, the memory 807 may be coupled to the processor unit 801. The computing system 800 may further include any number of optical sensors, accelerometers, magnetometers, microphones, gyroscopes, temperature sensors, and so forth for verifying user biometrics, or environmental conditions, such as motion, light, or other events that may be associated with the wireless earpieces or their environment.

The illustrative embodiments are not to be limited to the particular embodiments and examples described herein. In particular, the illustrative embodiments contemplate numerous variations in the type of ways in which embodiments of the invention may be applied to music teaching, playback, and communication utilizing inaudible tones. The foregoing description has been presented for purposes of illustration and description. It is not intended to be an exhaustive list or limit any of the disclosure to the precise forms disclosed. It is contemplated that other alternatives or exemplary aspects are considered included in the disclosure. The description is merely examples of embodiments, processes or methods of the invention. It is understood that any other modifications, substitutions, and/or additions may be made, which are within the intended spirit and scope of the disclosure. For the foregoing, it can be seen that the disclosure accomplishes at least all of the intended objectives.

The previous detailed description is of a small number of embodiments for implementing the invention and is not intended to be limiting in scope. The following claims set forth a number of the embodiments disclosed with greater particularity.

What is claimed is:

1. A method for utilizing inaudible tones for music, comprising:

initiating music with enhanced features;

determining whether inaudible tones including information or data are associated with a portion of the music; and playing the music associated with the inaudible tone including the inaudible tones associated with the portion of the music, wherein the inaudible tones are utilized to display notes associated with the music in time with the tempo of the music.

2. The method of claim 1, wherein the inaudible tones are audio frequencies that are not discernable by humans.

3. The method of claim 1, wherein the notes include each instrumental, voice, and note associated with the music, and wherein the music is a song.

4. The method of claim 1, wherein the playing includes playing all content, data, and instructions related to the music.

5. The method of claim 1, wherein displaying the notes further comprises displaying and moving the sheet music notes, tablatures, measures, and instructions associated with the music in synchronization with each musical or tempo change in the music.

6. The method of claim 1, wherein the displaying is performed repeatedly for a plurality of different portions and each instrument used in the music.

7. The method of claim 6, wherein the plurality of different portions of the song are associated with a plurality of inaudible tones and associated information.

8. The method of claim 1, wherein the notes of the music are synchronized with visual and instructional data contained in the inaudible tones.

9. The method of claim 1, wherein data include in the inaudible tones of the music represents sheet music, notes, tablatures, measures, or musical instructions.

10. The method of claim 1, further comprising:

displaying the information and data associated with the inaudible tones.

11. A method for utilizing inaudible tones for music, comprising:

receiving music and inaudible tones associated with the music utilizing an electronic device including at least a display;

extracting information associated with the inaudible tones; and communicating the information associated with the inaudible tones, including wherein the inaudible tones are utilized to display notes associated with the music in time with the tempo of the music.

12. The method of claim 11, wherein the inaudible tones are audio frequencies that are not discernable by humans, wherein the inaudible tones are embedded in the music.

13. The method of claim 11, further comprising:

implementing one or more actions associated with the inaudible tones.

14. The method of claim 11, wherein the notes includes one or more of notes, tablatures, measures, and instructions.

15. The method of claim 11, wherein the information is extracted utilizing demodulation.

16. A system for utilizing inaudible tones in music, comprising:

a transmitting device configured to broadcast music synchronized with one or more inaudible tones;

a receiving device that receives the inaudible tones, extracts information associated with the inaudible tones, and communicates the information associated with the inaudible tones including at least notes associated with the music in time with the tempo of the music, wherein the inaudible tones are utilized to display notes.

17. The system of claim 16, wherein the transmitting device utilizes one or more speakers to broadcast the music and the inaudible tones, and wherein the inaudible tones are audio frequencies that are not discernable by humans.

18. The system of claim 16, wherein the information is displayed to a user and provides visual and text information associated with the music.

19. The system of claim 16, wherein the inaudible tones are received by a plurality of devices simultaneously, wherein the information is uniquely associated with a user profile available on each of the plurality of devices.

20. The system of claim 16, wherein the transmitting device encodes the information in the inaudible tones and the receiving device decodes the information from the inaudible tones.

* * * * *